US012389966B2

(12) United States Patent
Lin et al.

(10) Patent No.: US 12,389,966 B2
(45) Date of Patent: Aug. 19, 2025

(54) BRA SHOULDER STRAP AND BRA

(71) Applicant: Shenzhen Lute Jiacheng Supply Chain Management Co., Ltd., Shenzhen (CN)

(72) Inventors: Jiehua Lin, Shenzhen (CN); Qian Feng, Shenzhen (CN)

(73) Assignee: Shenzhen Lute Jiacheng Supply Chain Management Co., Ltd., Shenzhen (CN)

( * ) Notice: Subject to any disclaimer, the term of this patent is extended or adjusted under 35 U.S.C. 154(b) by 0 days.

(21) Appl. No.: 18/504,449

(22) Filed: Nov. 8, 2023

(65) Prior Publication Data

US 2025/0120463 A1 Apr. 17, 2025

(30) Foreign Application Priority Data

Oct. 13, 2023 (CN) ..... 202322759092.9

(51) Int. Cl.
*A41F 15/00* (2006.01)
*A41C 3/12* (2006.01)

(52) U.S. Cl.
CPC ..... *A41F 15/00* (2013.01); *A41C 3/12* (2013.01)

(58) Field of Classification Search
CPC ..... A41F 15/00; A41C 3/12
USPC ..... 450/86
See application file for complete search history.

(56) References Cited

U.S. PATENT DOCUMENTS 5,558,556 A * 9/1996 Froehlich ..... A41F 15/007 2/268
5,614,303 A * 3/1997 Baigas, Jr. ..... D04H 1/4374 442/247
2004/0259469 A1* 12/2004 Cano ..... A41F 15/007 450/86
2008/0032599 A1* 2/2008 Kaye ..... A41F 15/02 450/86

FOREIGN PATENT DOCUMENTS

CN 211747030 * 10/2020

* cited by examiner

*Primary Examiner* — Gloria M Hale
(74) *Attorney, Agent, or Firm* — Westbridge IP LLC

(57) ABSTRACT

Disclosed are a bra shoulder strap and a bra. The bra shoulder strap includes an outer fabric layer, an inner fabric layer and a sandwich piece provided between the outer fabric layer and the inner fabric layer. The outer fabric layer, the sandwich piece and the inner fabric layer are stacked in sequence.

5 Claims, 1 Drawing Sheet

BRA SHOULDER STRAP AND BRA

CROSS-REFERENCE TO RELATED APPLICATIONS

This application claims priority to Chinese Patent Application No. 202322759092.9, filed on Oct. 13, 2023, the entire contents of which are incorporated herein by reference.

TECHNICAL FIELD

The present application relates to the technical field of bras, and in particular to a bra shoulder strap and a bra.

BACKGROUND

The bra is a kind of clothing that supports, covers and protects female breasts. By combining a bra body and two cups, and connecting the bra shoulder strap to the outside of the cup and the upper edge of the cup, the basic functional structure of the bra is formed. The main function of the bra shoulder strap is to lift the breasts. Existing bra shoulder straps are generally composed of two layers of fabric, which have poor load-bearing strength, and pressing marks will be caused on female's shoulder after long-term wear.

SUMMARY

The main purpose of the present application is to provide a bra shoulder strap and a bra, aiming to solve the problem that existing bra shoulder straps have poor load-bearing strength.

In order to solve the above objectives, the present application provides a bra shoulder strap, including an outer fabric layer; an inner fabric layer; and a sandwich piece provided between the outer fabric layer and the inner fabric layer. The outer fabric layer, the sandwich piece and the inner fabric layer are stacked in sequence.

In an embodiment of the present application, the bra shoulder strap includes two first sections and a second section, the second section is wider than the first section, both ends of the second section are connected to one end of the two first sections, and another end of the two first sections is connected to a back strap of a bra and a beltloop of the bra respectively; and the second section includes the outer fabric layer, the inner fabric layer and the sandwich piece.

In an embodiment of the present application, a width of the second section gradually increases from both ends of the second section towards a middle of the second section.

In an embodiment of the present application, a width of the two first sections gradually decreases from an end of the two first sections close to the second section towards an end of the two first sections far away from the second section.

In an embodiment of the present application, both ends of the outer fabric layer extend towards the inner fabric layer and are folded towards the inner fabric layer to wrap the inner fabric layer.

In an embodiment of the present application, a joint between the outer fabric layer and the inner fabric layer is bonded by dispensing process.

In an embodiment of the present application, the outer fabric layer and the sandwich piece are bonded by dispensing process, and the sandwich piece and the inner fabric layer are bonded by dispensing process.

In an embodiment of the present application, both the outer fabric layer and the inner fabric layer are made of chinlon.

In an embodiment of the present application, the sandwich piece includes a polyester filament layer, a low stretch yarn layer and a polyester filament layer stacked in sequence.

The present application further provides a bra, including the bra shoulder strap as mentioned above.

Compared with the existing technology, the bra shoulder straps and the bra in the present application have the following beneficial effects.

In the technical solution of the present application, by providing the sandwich pieces, the load-bearing strength of the bra shoulder strap can be enhanced. In this way, not only the lifting effect of the shoulder straps on the bra can be satisfied to better lift the breasts, but also the comfort of the shoulder straps can be improved, thereby reducing the pressing marks on the shoulder after long-term wear.

BRIEF DESCRIPTION OF THE DRAWINGS

To illustrate the technical solutions according to the embodiments of the present application or the related art more clearly, the accompanying drawings for describing the embodiments or the related art are introduced briefly in the following. Apparently, the accompanying drawings in the following description are only about some embodiments of the present application, and persons of ordinary skill in the art can derive other drawings from the accompanying drawings without creative efforts.

Figure 1:
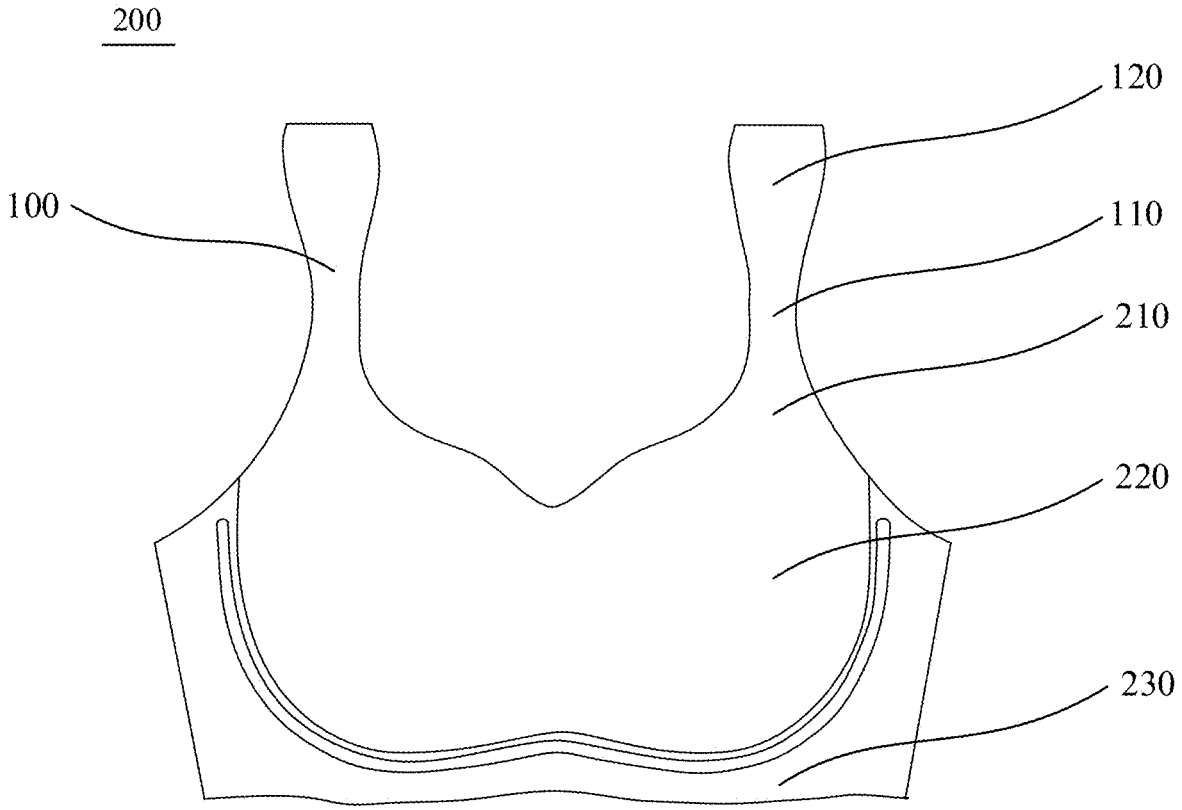
FIG. 1 is a schematic view of an overall structure of a bra according to an embodiment of the present application.

The realization of the objective, functional characteristics, and advantages of the present application are further described with reference to the accompanying drawings.

DETAILED DESCRIPTION OF THE EMBODIMENTS

The technical solutions of the embodiments of the present application will be described in detail below with reference to the accompanying drawings. It is obvious that the embodiments described are only some rather than all of the embodiments of the present application. All other embodiments obtained by those skilled in the art based on the embodiments of the present application without creative efforts shall fall within the claimed scope of the present application.

It should be noted that all the directional indications (such as up, down, left, right, front, rear . . . ) in the embodiments of the present application are only used to explain the relative positional relationship, movement, or the like of the components in a certain posture (as shown in the drawings). If the specific posture changes, the directional indication will change accordingly.

Besides, the descriptions associated with, e.g., "first" and "second," in the present application are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the technical solutions of the various embodiments can be combined with each other, but the combinations must be based on the realization of those skilled in the art. When the combination of technical solutions is contradictory or cannot be achieved, it should be considered that such a combination of technical solutions does not exist, nor does it fall within the scope of the present application.

Figure 2:
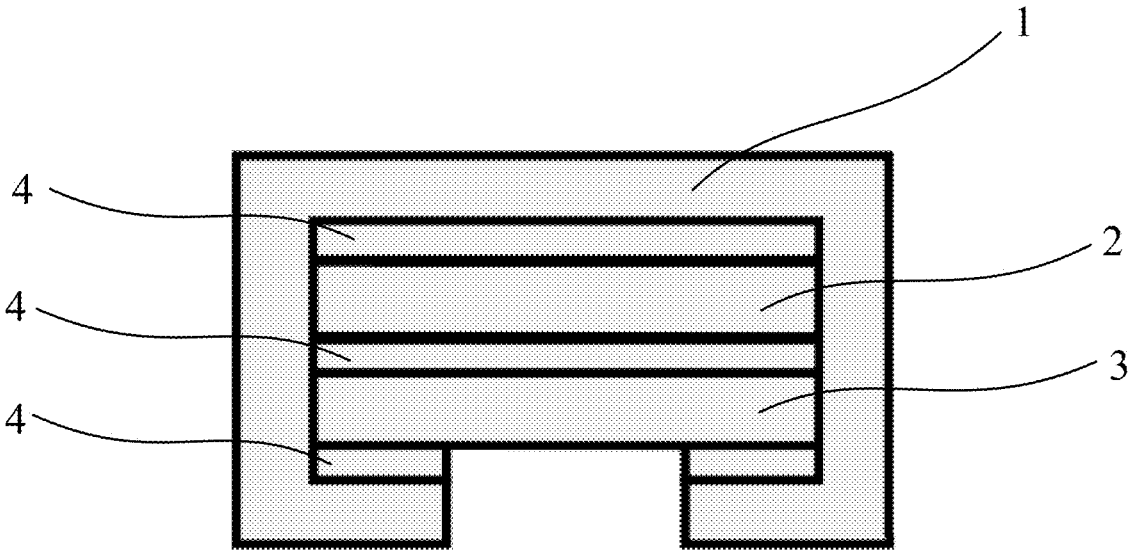
FIG. 2 is a schematic view of a stacked structure of a bra shoulder strap according to an embodiment of the present application.

As shown in FIG. 1 and FIG. 2, the present application proposes a bra shoulder strap 100. The bra shoulder strap 100 includes an outer fabric layer 1, an inner fabric layer 2 and a sandwich piece 3. The sandwich piece 3 is provided between the outer fabric layer 1 and the inner fabric layer 2, and the outer fabric layer 1, the sandwich piece 3 and the inner fabric layer 2 are stacked in sequence.

In an embodiment, the bra shoulder strap 100 has three layers, namely the outer fabric layer 1, the inner fabric layer 2 and the sandwich piece 3. The sandwich piece 3 is provided between the outer fabric layer 1 and the inner fabric layer 2. The sandwich piece 3 not only has good stretch, but also is not easy to deform, and can bear strong pulling force. Therefore, adding the sandwich piece 3 into the bra shoulder strap 100 can enhance the overall load-bearing strength of the bra shoulder strap 100, and can lift the female breasts well.

In addition, the sandwich piece 3 has a poroid structure with high resilience force, and can quickly recover after deformation. The poroid structure also makes the bra shoulder strap 100 have a buffering effect and more comfortable to wear.

In the technical solution of the present application, by providing the sandwich pieces 3, the load-bearing strength of the bra shoulder strap 100 can be enhanced. In this way, not only the bra shoulder strap 100 has high lifting force to meet the lifting effect of the bra shoulder strap 100 on the bra to better lift the breasts, but also the elastic design of the strap 100 is more reasonable, to relieve the pressure of the bra shoulder strap 100 on the shoulder, improve the comfort of the bra shoulder strap 100, and reduce the pressing marks on the shoulder after long-term wear.

In an embodiment of the present application, the bra shoulder strap 100 includes two first sections 110 and a second section 120. The second section 120 is wider than the first section 110. Both two ends of the second section 120 are connected to one end of the two first sections 110, and another end of the two first sections 110 are respectively connected to the back strap (not shown) of the bra 200 and the beltloop 210 of the bra 200. The second section 120 includes the outer fabric layer 1, the inner fabric layer 2 and the sandwich piece 3.

It should be understood that the existing bra shoulder strap are generally of the same width, and the bra shoulder strap is narrow, which will press the shoulder and form pressing marks. In severe cases, female shoulder skin will be red and swollen due to friction, and pains will be caused on the female shoulder after long-term wear.

In an embodiment, the bra shoulder strap 100 of the present application is provided with the first section 110 and the second section 120. The width of the second section 120 is greater than the first section 110. The width of the first section 110 and the second section 120 can be set according to actual needs. The two first sections 110 are respectively disposed at both ends of the second section 120 and are connected to both ends of the second section 120 respectively. The other ends of the two first sections 110 are connected to the back strap of the bra 200 and the beltloops 210 of the bra 200 respectively. The second section 120 is provided at a position close to the top of the shoulder, and the first sections 110 are provided on the front side and the back side of the shoulder. The bra shoulder strap 100 is provided with a second section 120, which can disperse the pressure on the top of the shoulder and improve comfort. The bra shoulder strap 100 is provided with the first section 110, which facilitates the movement of the front side and the back side of the shoulder.

In addition, the outer fabric layer 1, the inner fabric layer 2 and the sandwich piece 3 are only provided in the second section 120, to avoid that the whole bra shoulder strap 100 is thick and stuffy and to avoid inconvenient movement of the front side and the back side of the shoulder. Three layers of fabric are provided at the position close to the top of the shoulder, which can better increase the lifting force and disperse the pressure on the top of the shoulder, thereby improving wearing comfort.

In an embodiment of the present application, the width of the second section 120 gradually increases from both ends of the second section 120 towards the middle of the second section 120.

In an embodiment of the present application, the width of the two first sections 110 gradually decreases from an end of the first section 110 close to the second section 120 towards an end of the first section 110 far away from the second section 120.

It should be understood that the width of the second section 120 gradually increases along a direction from both ends of the second section 120 to the middle of the second section 120. That is, at the top position of the shoulder, the width of the second section 120 is greatest, and is greater than the width of the ordinary bra shoulder strap. The width of the first section 110 gradually decreases along a direction from an end of the first section 110 close the width section 120 to an end of the first section 110 away from the second section 120. The width of the first section 110 is greatest at the position close the second section 120, and the width of the first section 110 is smallest at the position close the cup 220.

The position where the bra shoulder strap 100 contacts the shoulder is wider, and is the widest at the top of the shoulder. The extension portion on both ends of the bra shoulder strap 100 gradually become narrower, which can disperse the pressure on the top of the shoulder, enhance the comfort of the bra shoulder strap 100, and avoid the occurrence of pressing marks. The extension portion on both ends of the bra shoulder strap 100 gradually become narrower, which can facilitate movements in the first section 110, improve comfort, and conform to ergonomics.

In an embodiment of the present application, both ends of the outer fabric layer 1 extend towards the inner fabric layer 2 and are folded towards the inner fabric layer 2 to wrap the inner fabric layer 2.

In an embodiment, as shown in FIG. 2, both ends of the outer fabric layer 1 extend towards the inner fabric layer 2 and are folded to contact with the outer surface of the inner fabric layer 2, so as to wrap the inner fabric from both sides of the inner fabric layer 2. Thus, the sandwich piece 3 can be wrapped to avoid that the sandwich piece 3 and the inner fabric layer 2 are exposed from the side and affect the appearance. Moreover, the outer fabric layer 1 is edge-wrapped so that the bra shoulder strap 100 is connected into a whole, which can increase the lifting force, better lift female breasts and meet people's dual needs for comfort and appearance.

In an embodiment of the present application, the joint between the outer fabric layer 1 and the inner fabric layer 2 is bonded by dispensing process 4.

It should be understood that the folded edge of the outer fabric layer 1 is attached to the outer surface of the inner fabric layer 2 to form a new fabric layer, which not only can connect the multiple layers of fabric of the bra shoulder strap 100 into a whole, but also can increase the lifting force. In addition, the joint between the outer fabric layer 1 and the inner fabric layer 2 are bonded by dispensing process 4 to better connect the bra shoulder strap 100 into a whole.

In an embodiment of the present application, the outer fabric layer 1 and the sandwich piece 3 are bonded by dispensing process 4, and the sandwich piece 3 and the inner fabric layer 2 are bonded by dispensing process 4.

In an embodiment, two layers of fabric can be connected to each other in a variety of methods, such as in a textile method or in a gluing method. In this embodiment, the outer fabric layer 1 and the sandwich piece 3 are bonded by dispensing process 4, and the sandwich piece 3 and the inner fabric layer 2 are also bonded by dispensing process 4, which can better maintain the stability and integrity of the bra shoulder strap 100, and the connection method is simpler.

Therefore, the stacked structure of the bra shoulder strap 100 is formed, as shown in FIG. 2. From outside to inside, there are the outer fabric layer 1, the dispensing process 4, the sandwich piece 3, the dispensing process 4, the inner fabric layer 2, the dispensing process 4, and the outer fabric layer 1, improving the support and comfort of the bra shoulder strap 100.

In an embodiment of the present application, the outer fabric layer 1 and the inner fabric layer 2 are made of chinlon.

In detail, there are many types of fabric for the outer fabric layer 1 and the inner fabric layer 2, which can be selected according to actual needs. In this embodiment, the outer fabric layer 1 and the inner fabric layer 2 are made of chinlon, which not only has good resilience and good wear resistance, and can lift the breasts well, but also is easy to wear and can improve wearing comfort.

In an embodiment of the present application, the sandwich piece 3 is a fabric piece formed by a polyester filament layer, a low stretch yarn layer and a polyester filament layer in sequence.

In an embodiment, the type of the sandwich fabric can be selected according to actual needs, which can be the polyester staple fiber, the monofilament and the polyester staple fiber, or can be the cotton, the monofilament and the cotton, and the like. In this implementation, the sandwich piece 3 is made of a polyester filament layer, a low stretch yarn layer and a polyester filament layer. The inner and outer layers of the sandwich piece 3 are made of the polyester filament fabric, and the middle layer of the sandwich piece 3 is made of the low stretch yarn. The low stretch yarn fabric is provided between the two layers of polyester filament yarn and is interlaced with the two layers of polyester filament yarn to form a whole structure. Therefore, the sandwich piece 3 can maintain a certain extension without loosening and deforming, which can not only enhance the load-bearing strength, but also can fit the skin more comfortably.

The present application further provides a bra 200. The bra 200 includes the above-mentioned bra shoulder strap 100.

In an embodiment, the bra 200 includes a cup 220, a surrounding portion 230 and a bra shoulder strap 100. Both ends of the back part of the surrounding portion 230 are connected to each other by the bra extender. The two cups 220 are symmetrically arranged and set at the front of the surrounding portion 230. The bottom end of the cup 220 is fixedly connected to the upper edge of the surrounding portion 230, and two bra shoulder straps 100 are connected to the two cups 220 correspondingly. One end of the bra shoulder strap 100 is connected to the upper edge of the cup 220, and the other end of the bra shoulder strap 100 is connected to the upper edge of the back part of the surrounding portion 230.

The bra shoulder strap 100 is provided with an outer fabric layer 1, an inner fabric layer 2 and a sandwich piece 3, which can improve the load-bearing strength, meet the lifting effect of the bra shoulder strap 100 on the bra, and reduce the pressure of the bra shoulder strap 100 on the shoulder. By using the bra shoulder strap 100 on the bra 200, not only the comfort of wearing the bra 200 can be greatly improved, but also pressing marks on the shoulder can be reduced, and the shoulder pain can be reduced. Moreover, the structure is simple and is easy to produce.

The above-mentioned embodiments are only some embodiments of the present application, and are not intended to limit the scope of the present application. Any equivalent structure conversion made with reference to the description and the accompanying drawings of the present application, directly or indirectly applied in other related technical fields, should all fall in the scope of the present application.

What is claimed is:

1. A bra shoulder strap, comprising:

an outer fabric layer;

an inner fabric layer; and a sandwich piece provided between the outer fabric layer and the inner fabric layer, wherein the outer fabric layer, the sandwich piece and the inner fabric layer are stacked in sequence, both the outer fabric layer and the inner fabric layer are made of chinlon, both ends of the outer fabric layer extend towards the inner fabric layer and are folded towards the inner fabric layer to wrap the inner fabric layer.

2. The bra shoulder strap of claim 1, wherein:

the bra shoulder strap comprises two first sections and a second section, the second section is wider than the first section, both ends of the second section are connected to one end of the two first sections, and another end of the two first sections is connected to a back strap of a bra and a beltloop of the bra respectively; and the second section comprises the outer fabric layer, the inner fabric layer and the sandwich piece.

3. The bra shoulder strap of claim 2, wherein a width of the second section gradually increases from both ends of the second section towards a middle of the second section.

4. The bra shoulder strap of claim 3, wherein a width of the two first sections gradually decreases from an end of the two first sections close to the second section towards an end of the two first sections far away from the second section.

5. A bra, comprising the bra shoulder strap of claim 1.

* * * * *